US006854614B2

(12) United States Patent
Sprick

(10) Patent No.: US 6,854,614 B2
(45) Date of Patent: Feb. 15, 2005

(54) CLOSURE HAVING AN IMPROVED THREAD DESIGN

(75) Inventor: William Douglas Sprick, Evansville, IN (US)

(73) Assignee: Rexam Medical Packaging, Inc., Evansville, IN (US)

( * ) Notice: Subject to any disclaimer, the term of this patent is extended or adjusted under 35 U.S.C. 154(b) by 148 days.

(21) Appl. No.: 09/933,919

(22) Filed: Aug. 21, 2001

(65) Prior Publication Data

US 2002/0011458 A1 Jan. 31, 2002

Related U.S. Application Data

(63) Continuation-in-part of application No. 09/435,089, filed on Nov. 5, 1999, now abandoned.

(51) Int. Cl.[7] ..... B65D 41/04
(52) U.S. Cl. ..... 215/329; 215/330; 215/349
(58) Field of Search ..... 215/329, 330, 215/331, 44, 349; 280/288

(56) References Cited

U.S. PATENT DOCUMENTS

| | | | | |
|---|---|---|---|---|
| 1,665,908 A | * | 4/1928 | Costello | 215/329 |
| 1,916,693 A | | 7/1933 | Scribner | |
| 3,987,921 A | | 10/1976 | Aichinger | |
| 4,193,509 A | | 3/1980 | Dunn, Jr. et al. | |
| 4,381,840 A | | 5/1983 | Ostrowsky | |
| 4,674,643 A | | 6/1987 | Wilde et al. | |
| 4,697,715 A | | 10/1987 | Beruvides | |
| 4,754,892 A | | 7/1988 | Retief | |
| 4,798,303 A | | 1/1989 | Arnold | |
| 4,913,299 A | | 4/1990 | Petro | |
| 5,292,020 A | | 3/1994 | Narin | |
| 5,785,195 A | | 7/1998 | Zwemer et al. | |
| 6,047,840 A | | 4/2000 | Moore et al. | |
| 6,102,233 A | | 8/2000 | Waugh | |

FOREIGN PATENT DOCUMENTS

| | | | |
|---|---|---|---|
| CH | 226897 | * | 8/1943 |
| CH | 597052 | * | 10/1977 |
| EP | 0 232 856 | | 8/1987 |
| FR | 2 565 939 | | 12/1985 |
| GB | 1139018 | | 1/1969 |
| GB | 1172608 | | 12/1969 |
| GB | 2166422 A | | 5/1986 |

* cited by examiner

*Primary Examiner*—Nathan J. Newhouse
(74) *Attorney, Agent, or Firm*—John F. Salazer; Middleton Reutlinger

(57) ABSTRACT

A closure for use on a container having an externally threaded neck is disclosed wherein an inner surface of a downwardly depending skirt portion of the closure cap includes a helical thread having a flat upper surface with a lower thread profile having a first depth greater than an upper thread profile of a second depth. The helical thread of the closure tapers into the sidewalk of the closure skirt. The closure is provided with a seal integral with the inner surface of the skirt, spaced from a top wall of the closure, and retained at a lowermost point along the downwardly depending skirt by a bead.

20 Claims, 5 Drawing Sheets

CLOSURE HAVING AN IMPROVED THREAD DESIGN

This application is a continuation-in-part of application Ser. No. 09/435,089, filed Nov. 5, 1999 now abandoned.

BACKGROUND OF THE INVENTION

This invention relates to a rotary jumped thread of a closure which will allow less removal force and a more consistent removal of the closure from a molding tool. More particularly, this invention relates to a novel thread design having a flat upper thread surface which tapers into the sidewalk of a closure.

SUMMARY OF THE INVENTION

It is an object of the present invention to provide a rotary jumped thread for a closure of a bottle container in order to reduce the amount of distortion in the closure currently resulting from the molding process.

It is another object of the present invention to provide a closure having a top wall with a skirt surrounding the top wall and extending downwardly therefrom with a terminating edge defining an open bottom end. A seal may be positioned between the top wall and a non-back-off bead which is integral with the skirt and adjacent the top wall. A helical thread having a substantially flat upper thread surface circumscribes the inner surface of the skirt. The thread has a lower thread profile end of a first depth and an upper thread profile end of a second depth wherein the first depth is greater than the second depth and the upper profile end extends downwardly from a top wall of the closure or a closure bead.

All of the above outlined objectives are to be understood as exemplary only and many more objectives of the invention may be gleaned from the disclosure herein. Therefore, no limiting interpretation of the objectives noted are to be understood without further reading of the entire specification, claims, and drawings included herewith.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
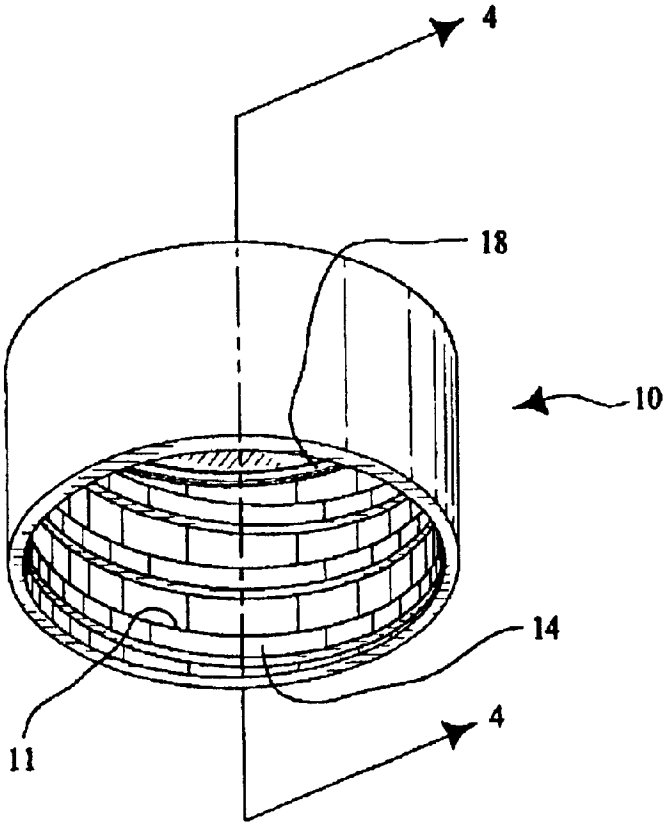
FIG. 1 is a lower perspective view of a closure with a rotary jumped thread of one preferred embodiment of the present invention.
Figure 3:
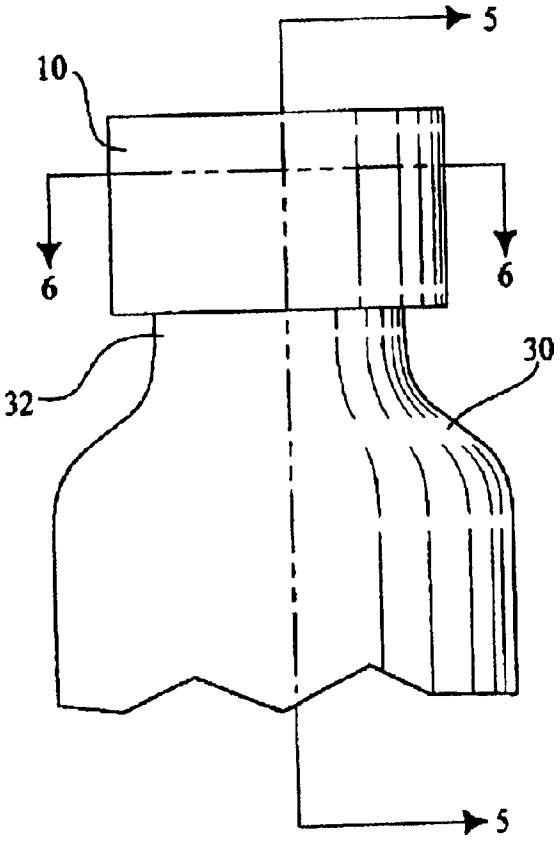
FIG. 3 is a side view of the container of FIG. 2 with the closure of FIG. 1 attached.
Figure 2:
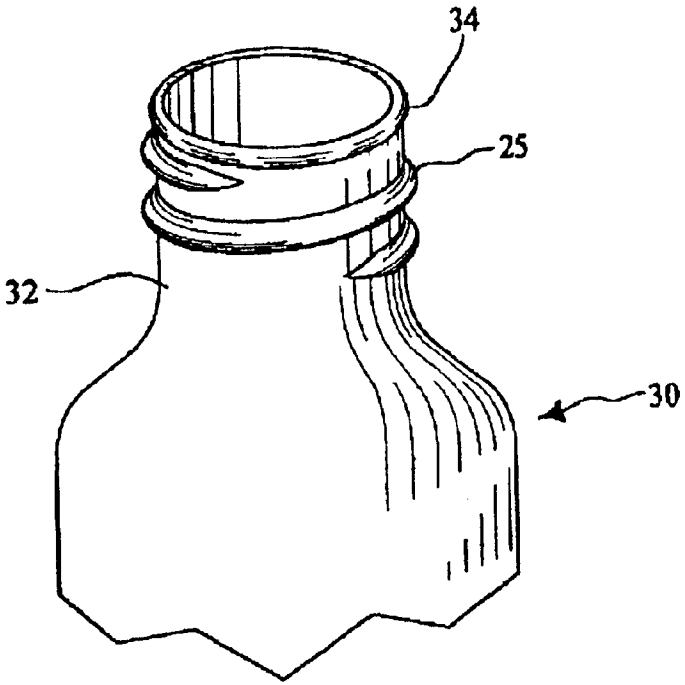
FIG. 2 is a side view of a neck finish of a typical container found in the art.

As shown in FIGS. 1–6, a container 30 includes a neck 32 for receipt of closure 10 thereon. The neck 32 is provided with a helical thread 25 circumferentially disposed around an outer surface for receiving a mating helical thread 14 of the closure 10. The closure 10 is comprised of a top wall 19 and a skirt 13 which surrounds the top wall 19 and extends downwardly therefrom with a terminating edge 15 opposite the top wall 19 defining an open bottom end 17.

A disc-shaped seal 22, integral with an inner surface 21 of the skirt 13, is disposed in an upper portion of the skirt 13 where the seal 22 is spaced at its lowermost point along the skirt 13 and above a bead 18, preferably a non-back-off bead. As bead 18 moves past a radial bulge 34 of the neck 32, a downward pressure is created properly sealing neck 32 against seal 22 thus preventing spillage or leakage.

The inner surface 21 of the skirt 13 is provided with a circumscribing helical thread 14. The helical thread 14 has a substantially flat upper thread surface 11 with a lower thread profile 12, near the open bottom end 17, of a first depth and an upper thread profile 16, near the top wall 19, of a second depth. The first depth, for example of about 0.0475 inches, is greater than the second, nominal depth, which maybe for example about 0.01 inch. The thread 14 may alternatively taper to a third depth of 0 inches where it becomes flush with the inner surface 21 of skirt 13. In either embodiment the upper thread profile 16 nearest the top wall 19 extends hectically downward either from the bead 18 or from a point beneath the bead. Helical thread 14 has a tapered depth, terminating either coincident to the inner surface 21 of the skirt 13, or at a nominal depth, prior to reaching bead 18.

For purposes of this invention, flat upper thread surface means that the upper surface 11 of the helical thread 14 is substantially perpendicular to the inner skirt surface 21. Since the upper thread surface 11 is flat the closure cannot be pushed from a mold core as with standard jumped thread designs. Jumped threads are those which have upper thread surfaces which are angled from the inner skirt surface 21, usually in the range of about 45 degrees. During production since the closure 10 cannot be pushed off of a mold core (not shown) due the flat upper thread surface 11, it must be rotated or unscrewed along its threads.

Although the closure 10 cannot be pushed from the mold core, the flat upper thread surface 11 provides several advantages to ordinary jumped threads. First, the flat upper thread surface 11 contacts the container threads, for example 25, to produce an axial sealing force. Since the surface 11 is flat, it is less likely to strip, as opposed to normal jumped threads having an angled upper thread surface and pushed from a mold core. As a result the flat upper thread surface 11 will withstand higher torque. The second advantage of having a flat upper thread surface is that better thread definition can be obtained. As a result, the threads are less likely to strip. The third advantage is that since the helical thread 14 stops short of the inside top wall 19, a seal 22 can be snapped into place between the bead 18 and the top wall 19 thus eliminating the need for use of glue. As a result the cost of production of the closure may be reduced. In addition, the seal 22 may be a liner less seal.

Figure 4:
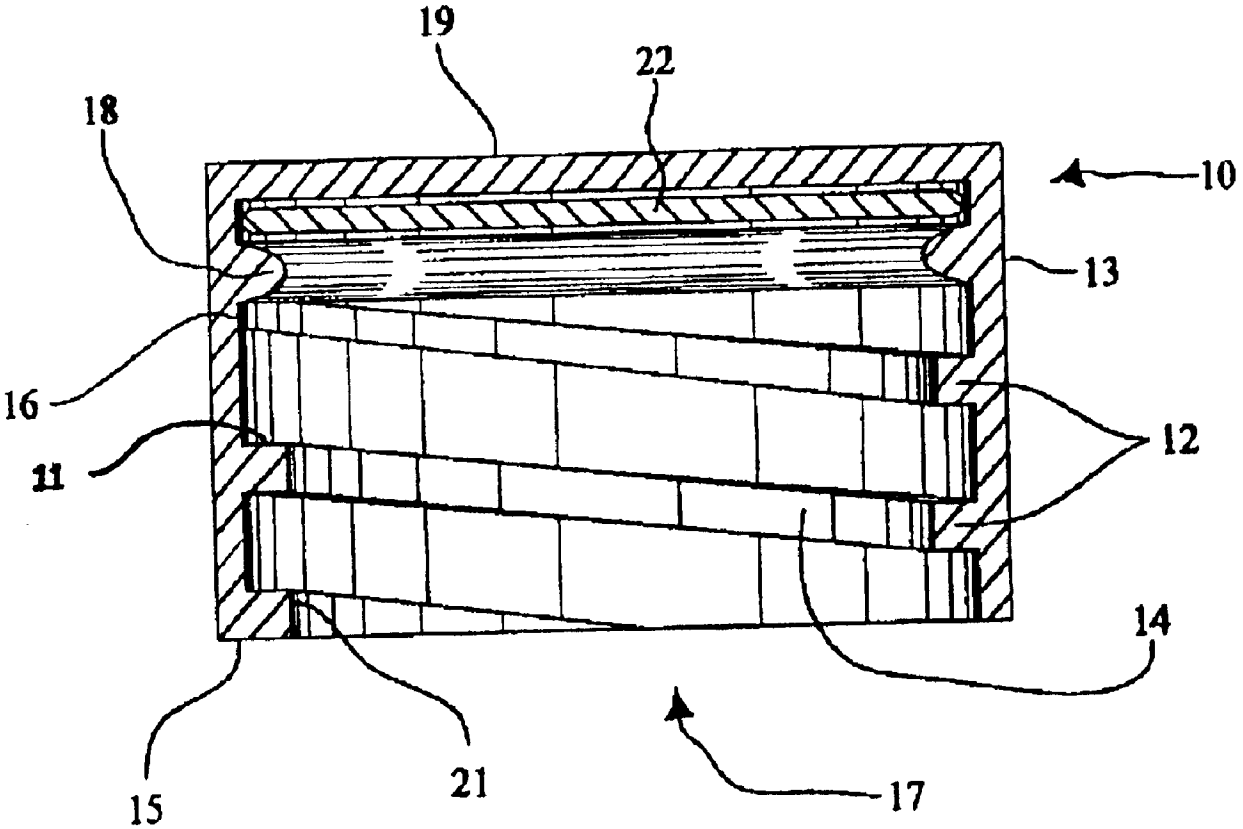
FIG. 4 is a sectional view of the preferred closure taken along line 4—4 in FIG. 1.
Figure 5:
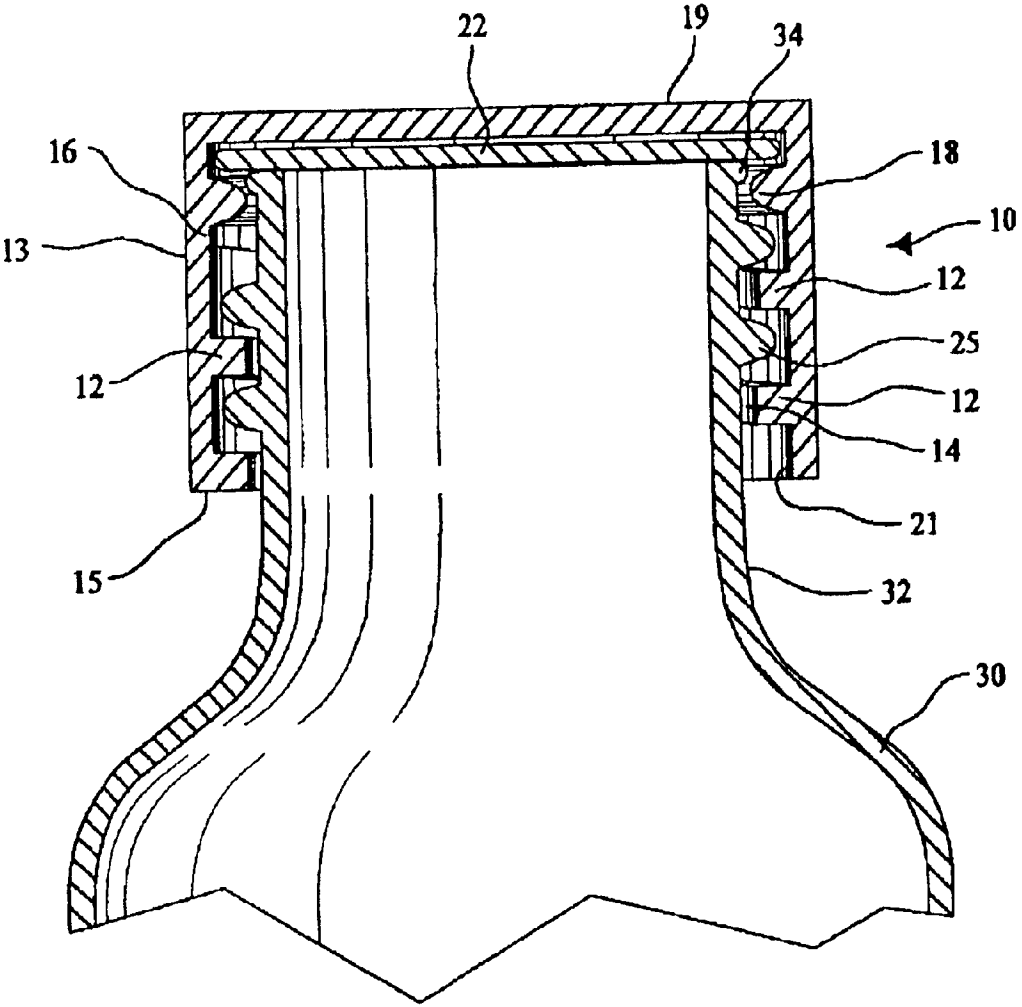
FIG. 5 is a sectional view of the closure and container taken along line 5—5 in FIG. 3; and, FIG. 6 is a top view of the closure with top wall removed.
Figure 6:
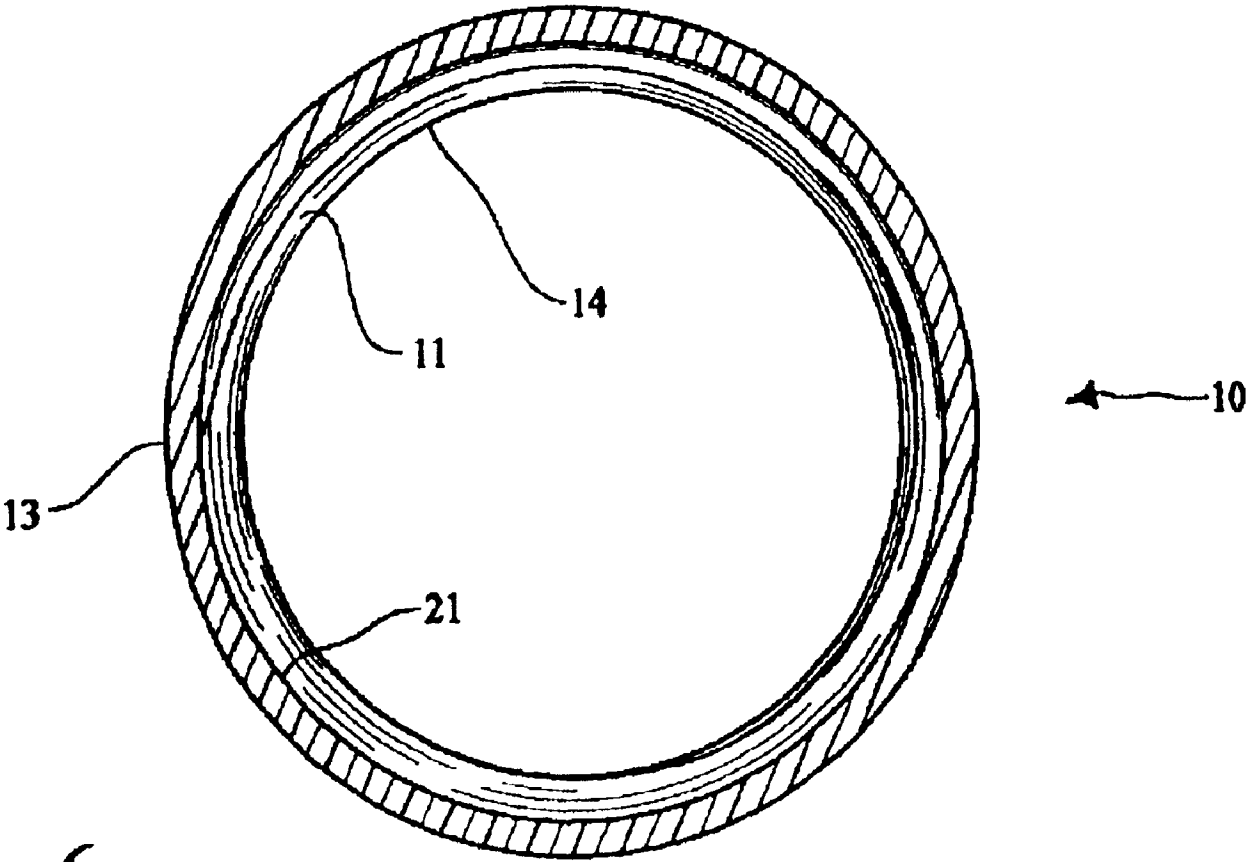

In forming a closure 10 of the present invention, the helical thread 14 may be tapered and/or it may be varied in depth along its entire arc length. Alternatively, the helical thread 14 may be variable in depth over the final 45° to 120° of arc from the end of the upper thread profile 16 and preferably over the final approximately 90°. The upper thread profile 16 may taper until it is flush with the inner surface 21 of skirt 13, as shown in FIGS. 4, 5, and 6 adjacent bead 18. In yet another alternative, the lower thread profile 12 may become flush with inner surface 13 of skirt 21 adjacent the open end of closure 10.

Another advantage of the closure 10 of the present invention is that it has less distortion during production.

When a closure 10 of this type is molded utilizing plastic or other thermos-resin material, the plastic retains heat introduced during the molding process in direct proportion to the thickness of the plastic. The closure 10 of the present invention utilizes a helical thread 14 and a bead 18. The bead 18 is necessarily thick in order to perform its function of positively and uniformly sealing the container without allowing the thread 14 to jump a portion of the thread 25 on the neck 32 of the container 30 and result in a non-uniform seal between the closure 10 and the container 30. In addition, the present invention discloses a thread 14 with a second depth as depicted by the upper thread profile 16. Because the second depth 16 is less than the first depth as depicted by the lower thread profile 12, the corresponding areas of the mold must be deeper in the area where the thread 14 is molded at the second depth.

In the molding of closures, it is the combination of heat retained in the thick bead 18 and mold deepness that results in distortion to the closure 10 as it is unscrewed from the mold. The closure 10 of the present invention limits the distortion inherent in the molding process by eliminating some of the thread depth 14 in the vicinity of the top wall by providing a lesser second depth in the vicinity of the high-molding-heat retaining bead 18. If the second depth was not less than the lower thread profile depth 12, more heat would be retained by the resin-material and distortion would be greater.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A closure comprising:

a top wall;

a skirt surrounding said top wall and extending downwardly therefrom with a terminating edge opposite said top wall defining an open bottom end;

a bead integral with an inner surface of said skirt and spaced from said top wall; and, a helical thread having a substantially flat upper thread surface circumscribing said inner surface of said skirt, said thread having a lower thread profile end of a first horizontal depth and an upper thread profile end of a second horizontal depth, said first horizontal depth being greater than said second horizontal depth, said upper thread profile extending downwardly from said non-back-off bead, said lower thread profile end being nearer said open bottom end than said upper thread profile end.

2. The closure of claim 1, including a seal on the inner surface of said top wall.

3. The closure of claim 2, said seal being positioned between said top wall and said bead.

4. The closure of claim 2, said seal being disc-shaped.

5. The closure of claim 2, said seal being liner less.

6. The closure of claim 1, said thread being tapered to a second horizontal depth terminating coincident to said inner surface of said skirt prior to reaching said bead.

7. The closure of claim 6, said second horizontal depth further tapering flush with said inner surface of said skirt.

8. The closure of claim 7, said second horizontal depth ending at a point coincident with a bead disposed between said top wall and said second horizontal depth.

9. The closure of claim 1, wherein said first horizontal depth is about 0.0475 inches and said second horizontal depth is about 0.01 inches.

10. The closure of claim 9, said thread being further tapered to a nominal horizontal depth terminating prior to reaching said bead.

11. The closure of claim 10, said thread diminishing in horizontal depth between said first and second horizontal depths.

12. The closure of claim 9, said thread diminishing in horizontal depth over an arc of between 45° and 120° from said upper thread profile end.

13. The closure of claim 9, said thread diminishing in horizontal depth over a 90° arc from said upper thread profile end.

14. A closure comprising:

a top wail and skirt depending from said top wall;

a bead integral with an inner surface of said skirt and spaced from said top wall; and, a helical thread having a substantially flat upper thread surface, a lower thread end of a first horizontal depth and an upper thread end of a second horizontal depth, said first horizontal depth being greater than said second horizontal depth, said upper thread end of said thread extending downwardly from said bead, and being closer to said top wall than said lower thread end.

15. The closure of claim 14, said thread being tapered to a horizontal depth terminating coincident to said inner surface of said skirt prior to reaching said bead.

16. The closure of claim 14, said thread being variable in horizontal depth over an are of about 90° of said upper thread portion end.

17. The closure of claim 14, wherein a seal is located between said bead and said top wall.

18. A closure comprising:

a top wall and an annular skirt depending from said top wall;

a bead integral with an inner surface of said skirt and spaced from said top wall;

a helical thread having a substantially flat upper thread surface, a lower thread profile end of a first horizontal depth and an upper thread profile end of a second horizontal depth, said upper thread profile end being nearer said top wall than said lower thread profile end, said first horizontal depth being greater than said second horizontal depth, said upper profile extending downwardly from said bead and said thread having a flat upper surface;

said thread being tapered to a horizontal depth terminating coincident to said inner surface of said skirt prior to reaching said bead; and, said thread being variable in horizontal depth over an arc of between 45° and 120° from said upper thread profile end.

19. The closure of claim 18, wherein a scald is located between said bead and said top wall.

20. A closure, comprising:

a circular top wall arid skirt depending therefrom;

a helical thread circumscribing an inner surface of said skirt and having a flat upper surface along its entire length, said flat upper surface being at an angle of about 90° to said skirt;

said helical thread having a lower profile end with a first horizontal depth of about 0.0475 inches and an upper profile of a second horizontal depth of about 0.01 inch, said upper thread profile being closer said top wall than said lower thread profile end;

said first horizontal depth being greater than said second horizontal depth such that said upper profile tapers into said skirt sidewalk from said second horizontal depth to a third horizontal depth of about 0 (zero) inches.

* * * * *